US005632140A

United States Patent [19]

Ballhausen et al.

[11] Patent Number: 5,632,140

[45] Date of Patent: May 27, 1997

[54] METHOD AND DEVICE FOR DIRECTLY MANUFACTURING A TWISTED YARN FROM DISSOLVED FIBER MATERIAL

[75] Inventors: Ulrich Ballhausen, Krefeld; Guido Spix, Kaarst; Wilfried Rütten, Wegberg, all of Germany

[73] Assignee: Palitex Project-Company GmbH, Krefeld, Germany

[21] Appl. No.: 521,664

[22] Filed: Aug. 31, 1995

[30] Foreign Application Priority Data

Aug. 31, 1994 [DE] Germany ..... 44 30 917.1

[51] Int. Cl.[6] ..... D01H 4/00; D01H 1/10

[52] U.S. Cl. ..... 57/409; 57/58.49; 57/58.52; 57/58.7; 57/58.83; 57/59; 57/60; 57/406; 57/408; 57/411

[58] Field of Search ..... 57/406, 408, 409, 57/411, 58.49, 58.52, 58.7, 58.83, 59, 60

[56] References Cited

U.S. PATENT DOCUMENTS

| | | | |
|---|---|---|---|
| 3,605,395 | 9/1971 | Morikawa et al. | 57/58.89 |
| 5,479,771 | 1/1996 | Ballhausen et al. | 57/406 |
| 5,499,496 | 3/1996 | Stenmans | 57/406 |

FOREIGN PATENT DOCUMENTS

| | | | |
|---|---|---|---|
| 78710 | 8/1969 | Germany . | |
| 2615505 | 10/1977 | Germany . | |
| 3534691 | 4/1987 | Germany | 57/58.52 |
| 4240226 | 8/1992 | Japan . | |

*Primary Examiner*—William Stryjewski
*Attorney, Agent, or Firm*—Robert W. Becker & Associates

[57] ABSTRACT

In a method for manufacturing a twisted yarn a spindle rotor is positioned in a stationary cylinder housing. At least two spinning devices are supported in a receiving chamber of the spindle rotor such that the spinning devices are located adjacent to one another and symmetrical to the central axis of the spindle rotor. A vacuum is generated within the receiving chamber. Dissolved fiber material is supplied from a fiber supply device to the hollow spindle axle of the spindle rotor. The individual fiber material is fed by the vacuum within the receiving chamber via the hollow spindle axle 6 of the spindle rotor 7 and via feed channels, connecting the hollow spindle axle to the spinning rotors, to the spinning devices. From the dissolved fiber materials spun yarns are spun in each one of the spinning devices. The spun yarns are gathered as a twisted yarn at a centering point positioned on the extension of the central axis of the spindle rotor. The twisted yarn is wound onto a spool.

6 Claims, 1 Drawing Sheet

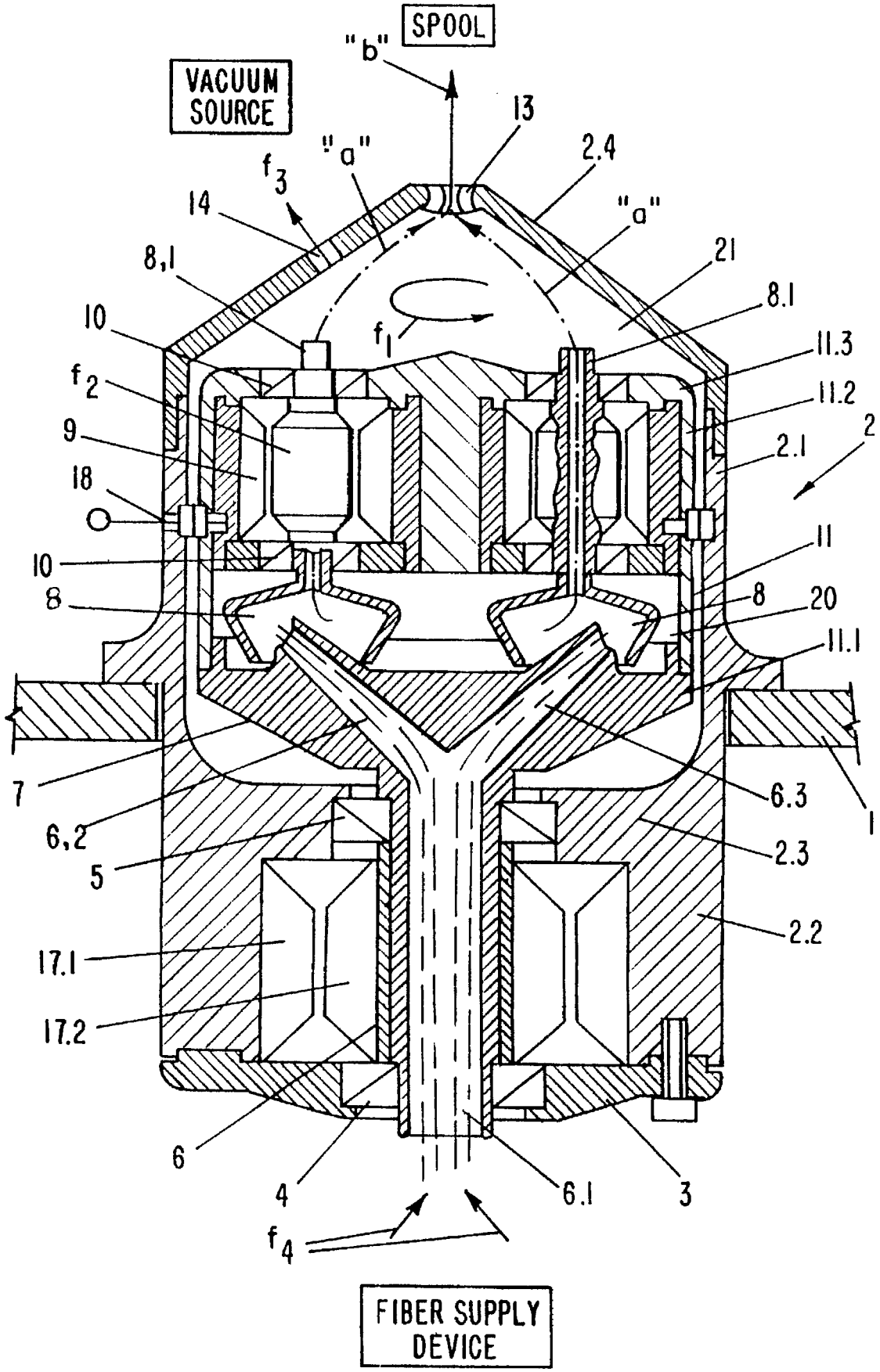
SPOOL
"b"
VACUUM SOURCE
13
2.4
"a"
f3
14
"a"
21
8,1
8.1
10
f1
11.3
f2
11.2
9
2.1
2
18
11
10
8
8
20
11.1
7
6.3
1
6,2
2.3
5
2.2
17.1
17.2
6
4
6.1
3
f4
FIBER SUPPLY DEVICE

METHOD AND DEVICE FOR DIRECTLY MANUFACTURING A TWISTED YARN FROM DISSOLVED FIBER MATERIAL

BACKGROUND OF THE INVENTION

The present invention relates to a method and a device with which it is possible to produce in one working step a finished twisted yarn from individualized (dissolved) fiber material directly after manufacturing the spun yarns.

Such combined or integrated spinning/twisting processes are, for example, known from East German Patent DD 78 710 as well as Japan published document 4-240 226.

In the methods disclosed in these printed documents, two open end spinning rotors arranged adjacent to one another within a spindle rotor are used for manufacturing individual spun yarns which are both subsequently guided, while the spindle rotor is rotating, to a centering point positioned on an extension of the central axis of the spindle rotor and are then wound with a winding device as a finished twisted yarn onto a spool to form a spool body.

The two aforementioned printed documents contain only general information with respect to the supply of the individualized (dissolved) fiber material to the spinning rotors without providing concrete solutions regarding the method or construction, for example, it is only mentioned that the supply of fibers to the spinning rotors should be especially performed pneumatically, in general, with a vacuum produced within the rotor chambers, as is, for example, disclosed for an individual spinning rotor in German Offenlegungsschrift 26 15 505.

It is therefore an object of the present invention to provide for a method and device of the aforementioned kind method steps and constructive features for supplying the individualized (dissolved) fiber material into the area of the spinning devices.

SUMMARY OF THE INVENTION

The inventive method for manufacturing a twisted yarn is primarily characterized by the following steps:

positioning in a stationary cylinder housing a spindle rotor;

supporting at least two spinning devices in a receiving chamber of the spindle rotor such that the spinning devices are located adjacent to one another and symmetrical to a central axis of the spindle rotor;

generating a vacuum within the receiving chamber;

supplying dissolved fiber material from a fiber supply device to a hollow spindle axle of the spindle rotor;

feeding by the vacuum within the receiving chamber the dissolved fiber material via the hollow spindle axle of the spindle rotor and via feed channels, connecting the hollow spindle axle to the spinning devices, to the spinning devices;

spinning from the individual fiber material spun yarns in each one of the spinning devices;

gathering the spun yarns at a centering point positioned on an extension of the central axis of the spindle rotor as a twisted yarn; and winding the twisted yarn onto a spool.

Preferably, the spinning devices are open end spinning rotors into which the feed channels open.

Expediently, the step of generating the vacuum includes the step of positioning a vacuum chamber between a vacuum source and the receiving chamber such that the vacuum chamber at least partially surrounds the spindle rotor and such that the vacuum chamber and the receiving chamber communicate via the hollow axles of the open end spinning rotors.

The present invention also relates to a device for manufacturing a twisted yarn according to the inventive method. The device is primarily characterized by:

a spindle rotor comprising a hollow spindle axle and a receiving chamber;

at least two spinning devices positioned in the receiving chamber of the spindle rotor such that the spinning devices are positioned adjacent to one another and symmetrical to a central axis of the spindle rotor;

a vacuum source for generating a vacuum within the receiving chamber;

a vacuum chamber connected to the vacuum source and communicating with a receiving chamber, the vacuum chamber at least partially surrounding the spindle rotor;

a fiber supply device for supplying individualized fiber material to a free end of the hollow spindle axle of the spindle rotor;

feed channels connected to an inner end of the hollow spindle axle and extending to the spinning devices, wherein the individualized fiber material is fed by the vacuum within the receiving chamber via the hollow spindle axle of the spindle rotor and via the feed channels to the spinning devices for spinning from the dissolved fiber material spun yarns in each one of the spinning devices;

a centering point for gathering the spun yarns as a twisted yarn, the centering point positioned on an extension of the central axis of the spindle rotor; and wherein the vacuum source generates a vacuum via the vacuum chamber and the receiving chamber within the hollow spindle axle and the free channels for supplying the dissolved fiber material to the spinning devices.

Advantageously, the spinning devices are open end spinning rotors that rotate in a direction counter to the direction of rotation of the spindle rotor, and each one of the open end spinning rotors has a hollow axle for connecting the vacuum chamber to the receiving chamber.

Advantageously, the device further comprises a stationary cylinder housing in which the spindle rotor is positioned and which encloses the vacuum chamber. The stationary cylinder housing has at least one opening to which is connected the vacuum source. The centering point is a bore in the cylinder housing through which the twisted yarn is removed from the stationary cylinder housing.

BRIEF DESCRIPTION OF THE DRAWING

The object and advantages of the present invention will appear more clearly from the following specification in conjunction with the accompanying drawing, in which the only FIGURE shows an axial section of the inventive device.

DESCRIPTION OF PREFERRED EMBODIMENTS

The present invention will now be described in detail with the aid of a specific embodiment utilizing the only FIGURE.

According to the drawing a stationary cylinder housing 2 is connected to a spindle rail 1 being part of an otherwise not-represented spinning/twisting machine. The cylinder housing 2 comprises an upper housing section 2.1 and a lower housing section 2.2 with intermediate partition 2.3. The lower end of the lower housing section 2.2 is closed off by a bottom 3. In openings of the partition 2.3 and of the bottom 3 bearings 4 and 5 for supporting the hollow spindle axle 6 of the spindle rotor 7 are arranged. The spindle rotor 7 comprises a pot 11, comprised of a pot bottom 11.1 connected to the hollow spindle axle 6, a cylindrical mantle 11.2, and a pot cover 11.3. The cylinder housing 2 is closed by a lid 2.4 positioned on the upper housing section 2.1 for producing a vacuum chamber 21. The lid 2.4 is provided with a suction opening 14 and on an extension of the axis of rotation of the spindle rotor 7, with a centering and yarn guide eye 13 functioning as a centering point.

Two spinning devices in the form of open end spinning rotors (spinning turbines) 8 are rotatably supported with bearings 10 in the spindle rotor 7 whereby their hollow axles 8.1 are upwardly oriented so as to open into the vacuum chamber 21 closed by the lid 2.4.

Feed channels 6.2 and 6.3 extending through the pot bottom 11.1 open into the spinning rotors 8 and are connected to the main feed channel 6.1 provided within the spindle rotor axle 6.

The spindle rotor 7 is driven in the direction of arrow f1, for example, by an electric motor, e.g., the schematically represented electric motor stator parts 17.1, respectively, electric motor rotor parts 17.2.

The spinning rotors 8 are also electrically driven in the direction of arrow f2 which is opposite to the rotational direction f1 of the spindle rotor 7, whereby the rotors 8 may be driven by the electric motor stator parts 9 which are positioned opposite corresponding rotor parts within the spinning rotors. The energy can be supplied for example, with a slip ring arrangement 18, as is conventional.

With a suction, respectively, vacuum source (the suction air flow is indicated by arrow f3) connected to the suction opening 14 a vacuum can be generated in the chamber 21 which is surrounded by the cylinder housing 2. The vacuum extends through the hollow axles 8.1 of the spinning rotors 8, into the spinning rotors 8 from there into the feed channels 6.2 and 6.3 opening into the spinning rotors, and into the main feed channel 6.1 so that fiber material is sucked into the spinning rotors in the direction of arrow f4.

When, while the spindle rotor 7 is rotating and the spinning rotors 8 are preferably rotating in the opposite direction, the fiber material is supplied by the vacuum through the feed channels 6.2 and 6.3 into the spinning rotors 8, spun fibers a are produced in the area of the spinning rotors 8. These spun fibers are removed in the upward direction through the hollow axles 8.1 of the spinning rotor and in the area of the centering, respectively, yarn guide eye 13 functioning as a centering point are gathered to form a twisted yarn b which is wound to a twisted yarn bobbin with a conventional yarn winding device which is, for example, generally provided at two-for-one twisting spindles.

Instead of two spinning rotors 8 it is also possible to provide a plurality, for example, three or four such spinning rotors 8, within the spindle rotor 7.

Upstream of the lower end of the hollow spindle axle 6, respectively, the main feed channel 6.1 a non-represented conventional fiber dissolving device is arranged.

The present invention is, of course, in no way restricted to the specific disclosure of the specification and drawings, but also encompasses any modifications within the scope of the appended claims.

What we claim is:

1. A method for manufacturing a twisted yarn, said method comprising the steps of:

positioning in a stationary cylinder housing a rotating spindle rotor;

supporting at least two spinning devices in a receiving chamber of the spindle rotor such that the spinning devices are located adjacent to one another and symmetrical to a central axis of the spindle rotor;

generating a vacuum within the receiving chamber;

supplying dissolved fiber material from a fiber supply device to a hollow spindle axle of the spindle rotor;

feeding by the vacuum within the receiving chamber the dissolved fiber material to the spinning devices via the hollow spindle axle of the spindle rotor and via feed channels connecting the hollow spindle axle to the spinning devices;

spinning from the dissolved fiber material spun yarns in each one of the spinning devices;

gathering the spun yarns at a centering point positioned on an extension of the central axis of the spindle rotor as a twisted yarn; and winding the twisted yarn onto a spool.

2. A method according to claim 1, wherein the spinning devices are open end spinning rotors into which the feed channels feed.

3. A method according to claim 2, wherein the open end spinning rotors have hollow axles and wherein the step of generating the vacuum includes the step of positioning a vacuum chamber between a vacuum source and the receiving chamber such that the vacuum chamber at least partially surrounds the spindle rotor and such that the vacuum chamber and the receiving chamber communicate via the hollow axles of the open end spinning rotors.

4. A device for manufacturing a twisted yarn, said device comprising:

a rotating spindle rotor comprising a hollow spindle axle and a receiving chamber;

at least two spinning devices positioned in said receiving chamber of the spindle rotor such that said spinning devices are positioned adjacent to one another and symmetrical to a central axis of the spindle rotor;

a vacuum source for generating a vacuum within said receiving chamber;

a vacuum chamber connected to said vacuum source and communicating with said receiving chamber, said vacuum chamber at least partially surrounding said spindle rotor;

a fiber supply device for supplying dissolved fiber material to a free end of said hollow spindle axle of the spindle rotor;

said hollow spindle axle having an inner end remote from said free end;

feed channels connected to said inner end of said hollow spindle axle and extending to said spinning devices, wherein the dissolved fiber material is fed by the vacuum within the receiving chamber via said hollow spindle axle of the spindle rotor and via said feed channels to said spinning devices for spinning from the dissolved fiber material spun yarns in each one of said spinning devices;

a centering point for gathering the spun yarns as a twisted yarn, said centering point positioned on an extension of the central axis of said spindle rotor; and wherein said vacuum source generates a vacuum via said vacuum chamber and said receiving chamber within said hollow spindle axle and said feed channels for supplying the dissolved fiber material to said spinning devices.

5. A device according to claim 4, wherein said spinning devices are open end spinning rotors that rotate in a direction counter to a direction of rotation of said spindle rotor and wherein each one of said open end spinning rotors has a hollow axle for connecting said vacuum chamber to said receiving chamber.

6. A device according to claim 4, further comprising a stationary cylinder housing in which said spindle rotor is positioned and which encloses said vacuum chamber, said stationary cylinder housing having at least one opening to which is connected said vacuum source, wherein said centering point is a bore in said stationary cylinder housing through which the twisted yarn is removed from said stationary cylinder housing.

* * * * *